US007658270B2

(12) United States Patent
Bochonok et al.

(10) Patent No.: US 7,658,270 B2
(45) **Date of Patent: *Feb. 9, 2010**

(54) COIN BIN HAVING SECURITY FEATURE FOR USE WITH A COIN PROCESSING DEVICE

(75) Inventors: Steve Bochonok, Wauconda, IL (US); Mark C. Munro, Park Ridge, IL (US); John R. Blake, St. Charles, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 662 days.

This patent is subject to a terminal disclaimer.

(21) Appl. No.: 10/966,857

(22) Filed: Oct. 14, 2004
(Under 37 CFR 1.47)

(65) Prior Publication Data

US 2007/0051582 A1 Mar. 8, 2007

Related U.S. Application Data

(60) Provisional application No. 60/511,039, filed on Oct. 14, 2003.

(51) Int. Cl.
*G07F 9/10* (2006.01)

(52) U.S. Cl. ..... 194/350; 232/7; 232/55

(58) Field of Classification Search ..... 194/202, 194/203, 344, 349, 353; 232/12, 44, 55–57, 232/4 R, 5–7, 14–16, 26, 58–61; 446/8, 446/10, 118, 168–170, 173; 193/DIG. 1; 109/15; 453/63

See application file for complete search history.

(56) References Cited

U.S. PATENT DOCUMENTS

| | | | | | |
|---|---|---|---|---|---|
| 1,268,723 | A * | 6/1918 | Johnson | 232/8 |
| 3,375,912 | A * | 4/1968 | Weitzman | 194/346 |
| 3,403,459 | A * | 10/1968 | Divilbiss | 434/118 |
| 3,685,202 | A * | 8/1972 | Morrison | 446/173 |
| 4,005,662 | A * | 2/1977 | Kohn et al. | 109/16 |
| 4,170,947 | A * | 10/1979 | Morgan | 109/16 |
| 4,230,213 | A * | 10/1980 | Spring | 194/348 |
| 4,756,406 | A * | 7/1988 | Grounds | 206/0.8 |
| 5,619,821 | A * | 4/1997 | St. George et al. | 49/57 |
| 5,806,652 | A * | 9/1998 | Johnson et al. | 194/347 |
| 5,880,394 | A * | 3/1999 | Kim | 89/36.02 |
| 6,336,544 | B1 * | 1/2002 | Blad et al. | 194/217 |
| 6,672,195 | B1 * | 1/2004 | Plattner | 89/36.11 |
| 6,811,401 | B1 * | 11/2004 | Cruickshank | 434/189 |
| 2006/0196754 | A1 * | 9/2006 | Bochonok et al. | 194/347 |

* cited by examiner

*Primary Examiner*—Jeffrey A Shapiro
(74) *Attorney, Agent, or Firm*—Nixon Peabody LLP

(57) ABSTRACT

According to one embodiment, a security grate for limiting access to a coin bin is disclosed. The security grate comprises a plurality of generally parallel upper slats and a plurality of generally parallel slats disposed below the upper slats. The plurality of first slats receives coins and directs coins moving under the force of gravity in a first direction. The plurality of lower slats receive coins from the upper slats and direct the coins moving under the force of gravity in a second direction.

9 Claims, 13 Drawing Sheets

COIN BIN HAVING SECURITY FEATURE FOR USE WITH A COIN PROCESSING DEVICE

This application claims the benefit of U.S. Provisional Patent Application No. 60/511,039, entitled "Coin Bin Having Security Feature For Use With A Coin Processing Device," filed on Oct. 14, 2003, which is incorporated herein by reference in its entirety.

TECHNICAL FIELD

This present concepts are directed generally to coin processing devices and, more specifically, to a coin bin having a security feature for use in a coin processing device.

BACKGROUND

Coin processing devices such as coin redemption machines allow users to exchange bulk coins deposits for another form of currency such as currency bills, a receipt that can be applied toward future purchases, or credited to an account. Typically, coin redemption machines are disposed in public locations such as in a retail store or bank. As such, there exists a need to house coins processed by the coin processing machines in a secure environment.

SUMMARY

According to one embodiment, a security grate for limiting access to a coin bin is disclosed. The security grate comprises a plurality of generally parallel upper slats and a plurality of generally parallel slats disposed below the upper slats. The plurality of first slats receives coins and directs coins moving under the force of gravity in a first direction. The plurality of lower slats receive coins from the upper slats and direct the coins moving under the force of gravity in a second direction.

In another aspect, a security grate for a coin bin includes a plurality of slats that define at least one coin path extending between a coin input area to an interior volume of an associated coin bin. The plurality of slats collectively defining a coin path that directs coins input thereto in a first direction along the coin path and in a second direction different than the first direction.

In still another aspect, a security grate for limiting access to a coin bin is provided which includes a plurality of upper slats and a plurality of lower slats disposed substantially below the plurality of upper slats. The plurality of upper slats are disposed to receive coins and direct coins moving thereby in a first direction and the plurality of lower slats are disposed to receive coins from the plurality of upper slats and direct the coins in a second direction.

In yet another aspect, there is provided a security grate for limiting access to a coin bin which includes a first coin path defined by at least a first upper slat and a first lower slat, the first upper slat being disposed in a generally downwardly first direction and the first lower slat being disposed in a generally downwardly second direction. A second coin path is defined by at least a second upper slat and a second lower slat, the second upper slat being disposed in the aforementioned first direction and the second lower slat being disposed in the aforementioned second direction. A third coin path is defined by at least a third upper slat and a third lower slat. The third upper slat is disposed in a generally downwardly third direction and the third lower slat is disposed in a generally downwardly fourth direction. The first upper slat, second upper slat, and third upper slat are disposed to receive coins from a coin source and to facilitate movement of such coins downwardly to the respective first lower slat, second lower slat, and third lower slat. Gaps between adjacent slats are dimensioned slightly larger than the diameter of the largest coin to be passed therethrough.

In another aspect, a coin bin for holding coins from a coin processing device, includes a plurality of walls, a floor, and a movable cover defining an interior volume for holding coins. The coin bin also includes at least one coin input area for receiving coins from the coin processing device, the coin input area protruding from the movable cover, and at least one security grate disposed within the at least one coin input area.

This summary of the present invention is not intended to represent each embodiment, or every aspect, of the present concepts. Additional features and benefits of the present concepts are apparent from the detailed description, figures, and claims set forth below.

Figure 1:
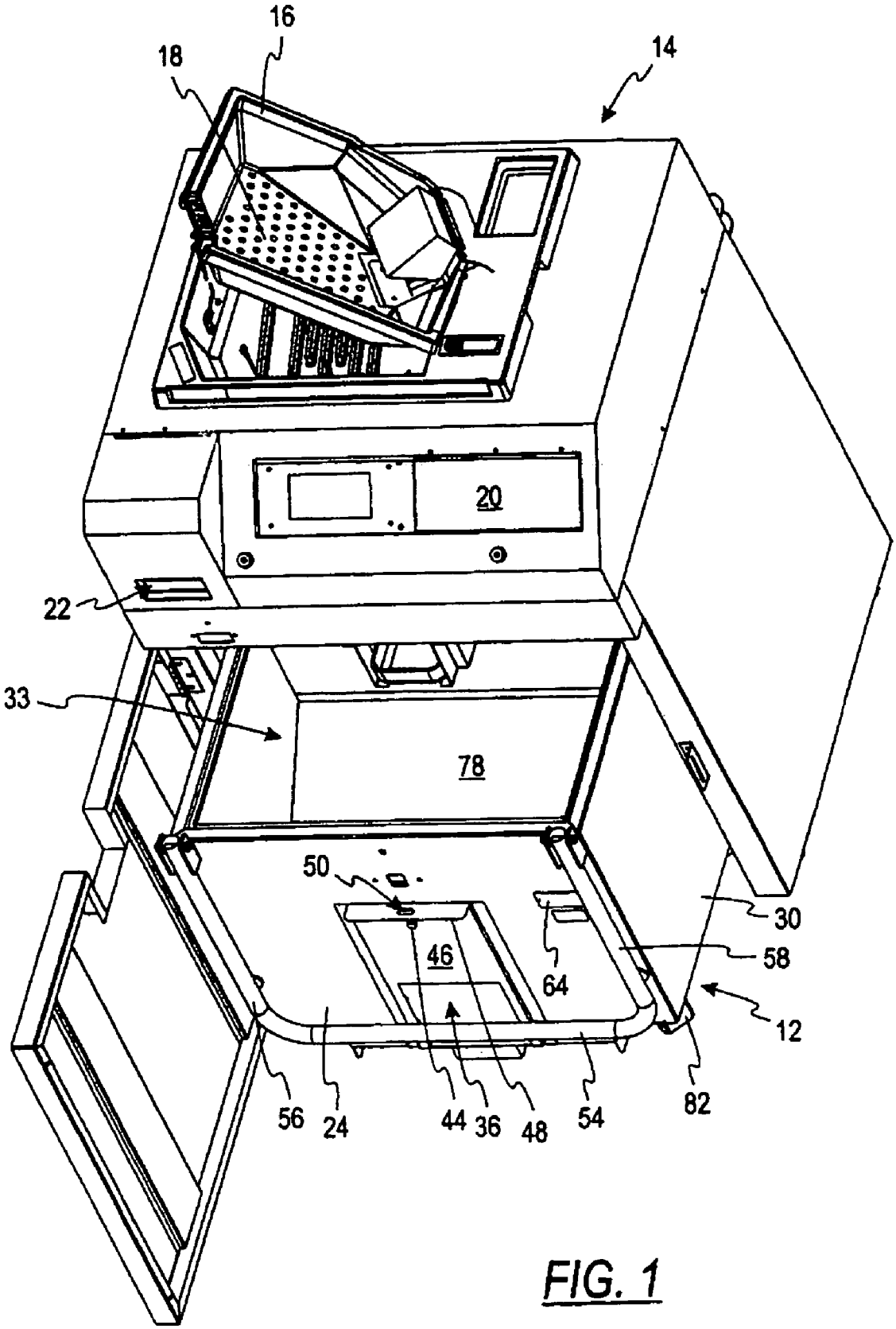
FIG. 1 is a perspective view of a removable coin bin and a coin processing device according to one embodiment of the present concepts.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Figure 2:
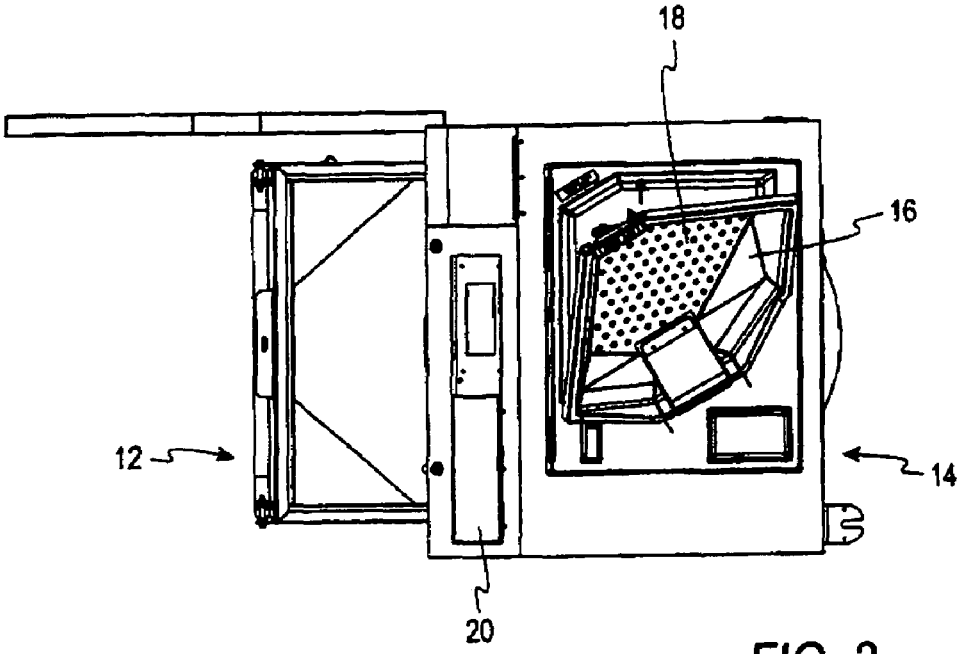
FIG. 2 is a top view of the coin bin and the coin processing device of FIG. 1*a*.
Figure 3:
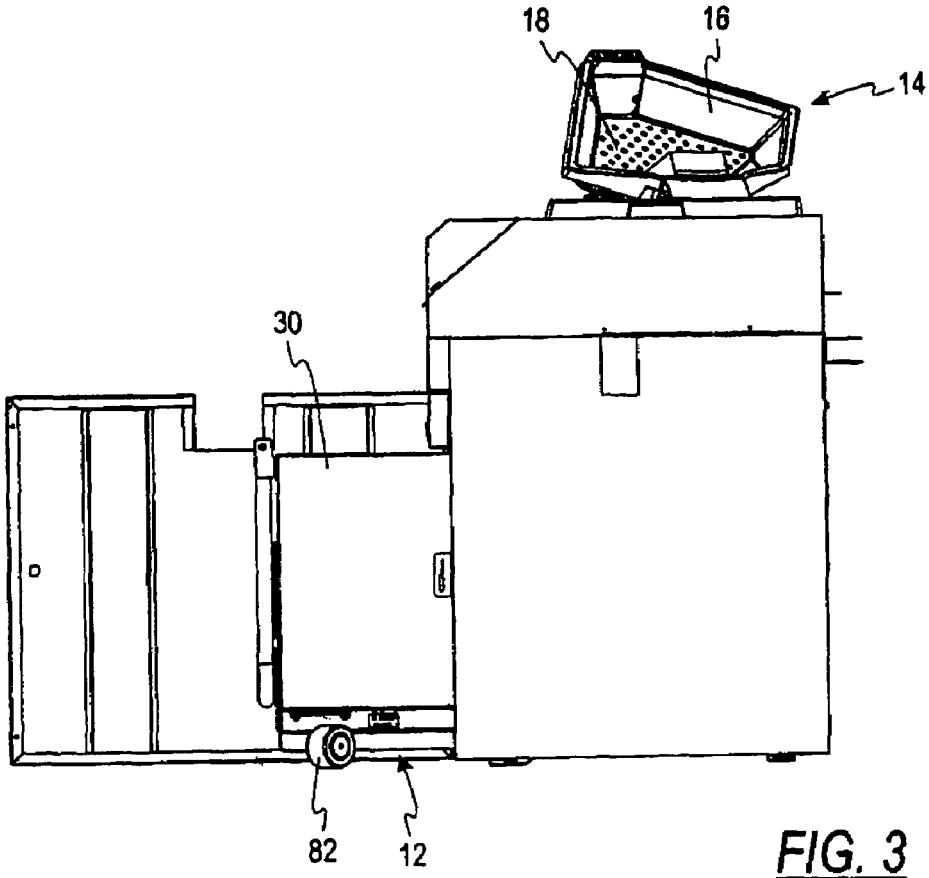
FIG. 3 is a side of the coin bin and the coin processing device of FIG. 1*a;*

Referring now to the drawings, and initially to FIGS. 1-3, one embodiment of a removable coin bin 12 is shown for use with a coin processing device 14, which may comprise a coin processing device for use with a coin redemption machine, automatic teller machine (ATM), coin counter, coin sorter, funds processing machine, vending machine, toll-booth machine, or a gaming machine.

The coin processing device 14 includes a coin input tray 16 for receiving coins from a user of the device 14. The coin input tray 16 includes a perforated bottom 18 for sifting out debris included with input coins. Once coins are received in the input tay 16, the user upwardly pivots (as shown in FIG. 1) input tray 16 causing coins to be directed under the force of gravity into the coin processing device. A coin tray similar to that described that may be used in connection with the coin processing device 14 is described in U.S. Pat. No. 4,964,495, which is incorporated herein by reference in its entirety.

A user interface 20 is disposed on the front of the coin processing device 14 for receiving user inputs and for displaying information to the user. According to one embodiment, the user interface 20 may comprise a touch-screen-type user interface. In other embodiments, the user interface may comprise a separate display and keypad.

The coin processing device 14 further includes a media slot 22 into which the user may insert an account card (e.g., a bank card such as an ATM card, an identification card including the type distributed by grocery stores, a smartcard, etc.). The media slot 22 is coupled to a media reader device or a media reader/writer device in the coin processing device 14 that is capable of reading from or writing to one or more types of media including ATM cards, credit card, smartcards, or other types of media cards. This media may include various types of memory storage technology such as magnetic storage, solid state memory devices, and optical devices. The user interface 20 typically provides the user with a menu of options which prompts the user to carry out a series of actions for identifying the user by displaying certain commands and requesting that the user input information (e.g., a user PIN, account number, etc.).

In general, when the coin processing device is used in a coin redemption application, the coin processing device 14 receives from a user as described, and after these deposited coins have been processed (e.g., authenticated, counted, sorted, or otherwise processed), the coin processing device 14 outputs a receipt to the user indicative of the dollar amount of the deposited coins. The user can redeem the receipt for funds from an attendant of the coin machine 14. An attendant may include a store employee such as a cashier at a grocery store or a teller at a bank. Alternatively, the user can redeem the receipt for credit towards purchases at the store where the machine is located.

Figure 4:
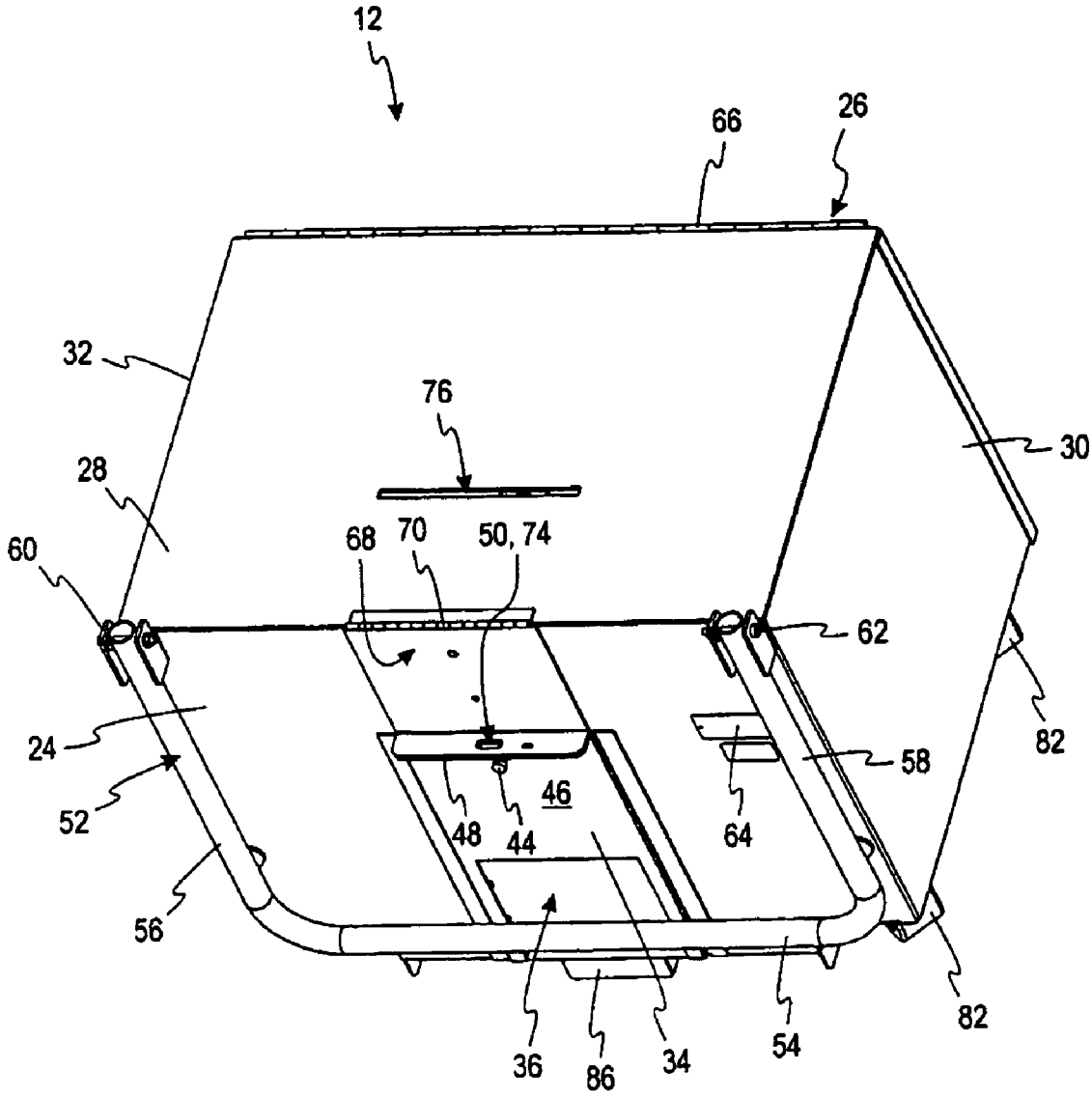
FIG. 4 is a perspective view of the coin bin of FIG. 1*a*.
Figure 5:
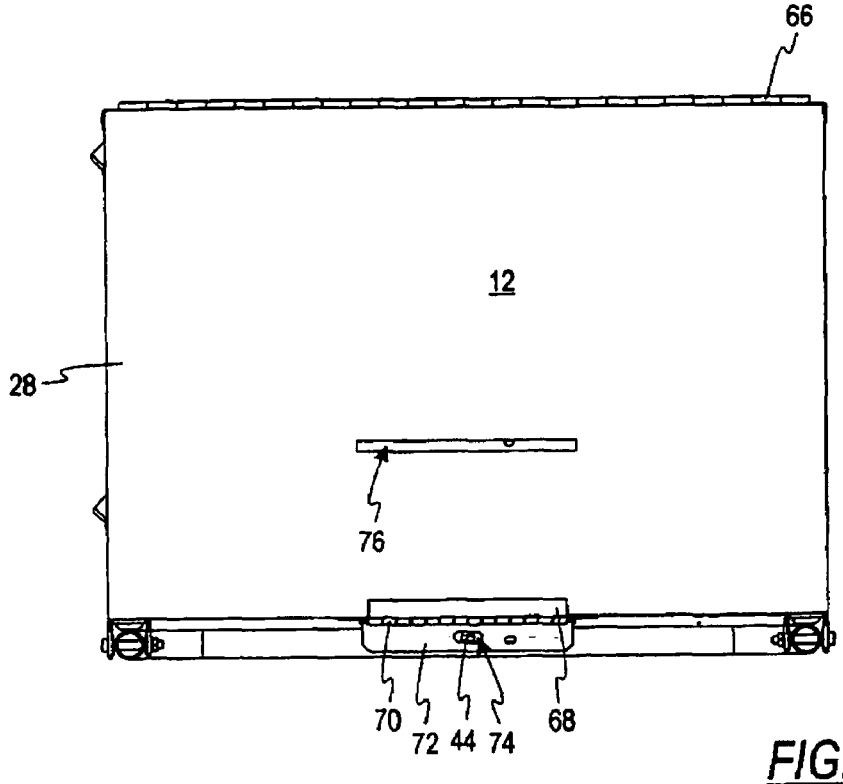
FIG. 5 is a top view of the coin bin of FIG. 2*b*.
Figure 6:
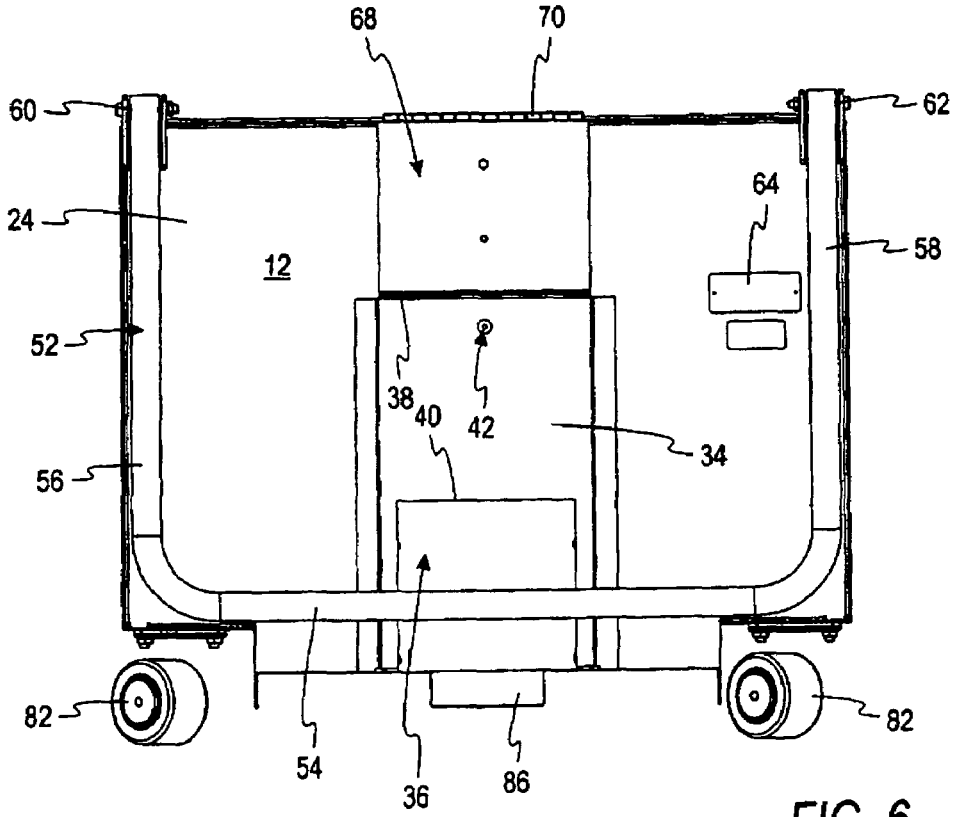
FIG. 6 is a front view the coin bin of FIG. 2*b*.
Figure 7:
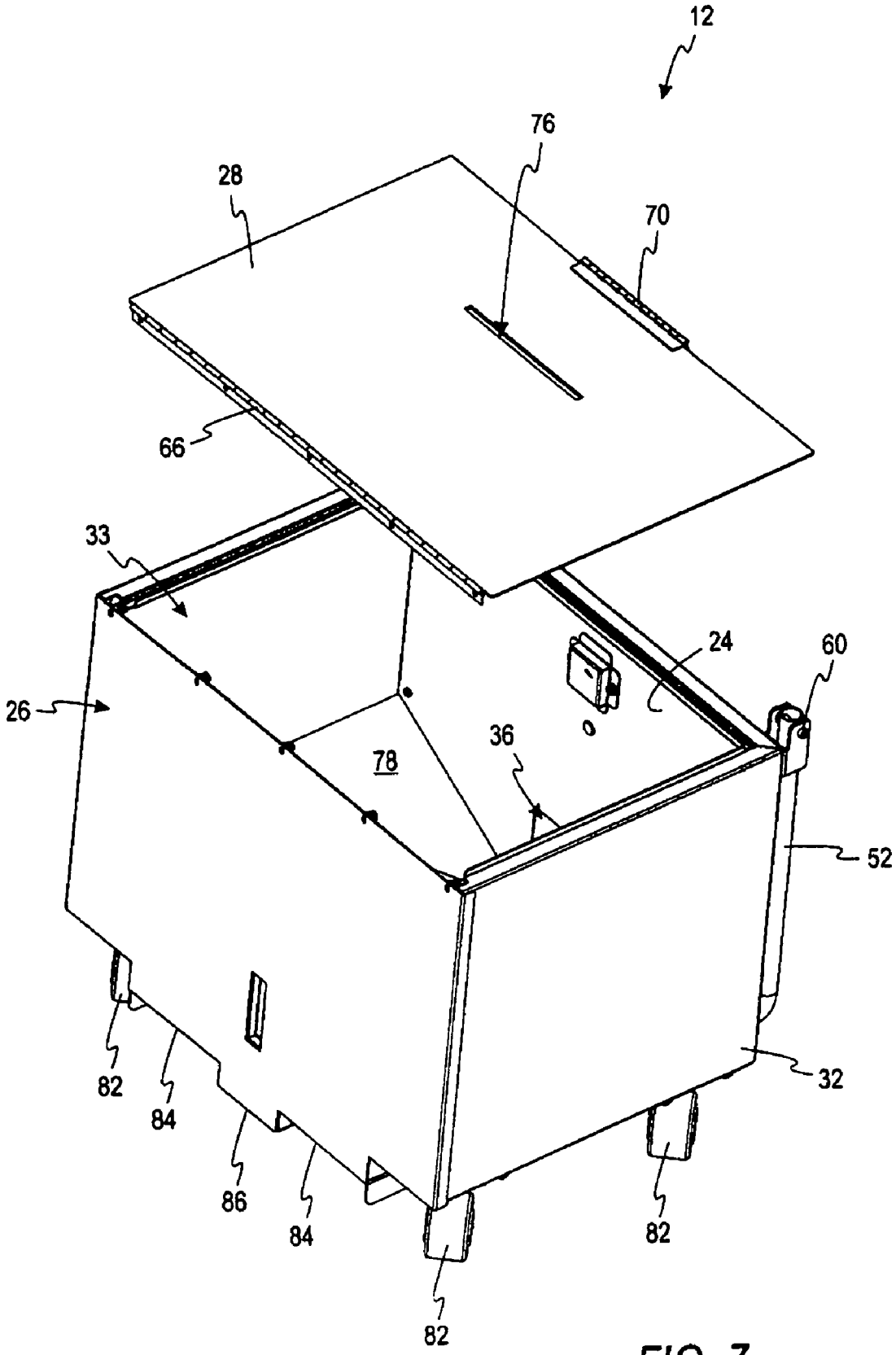
FIG. 7 is an exploded-perspective view of the coin bin of FIG. 1*a*.
Figure 8:
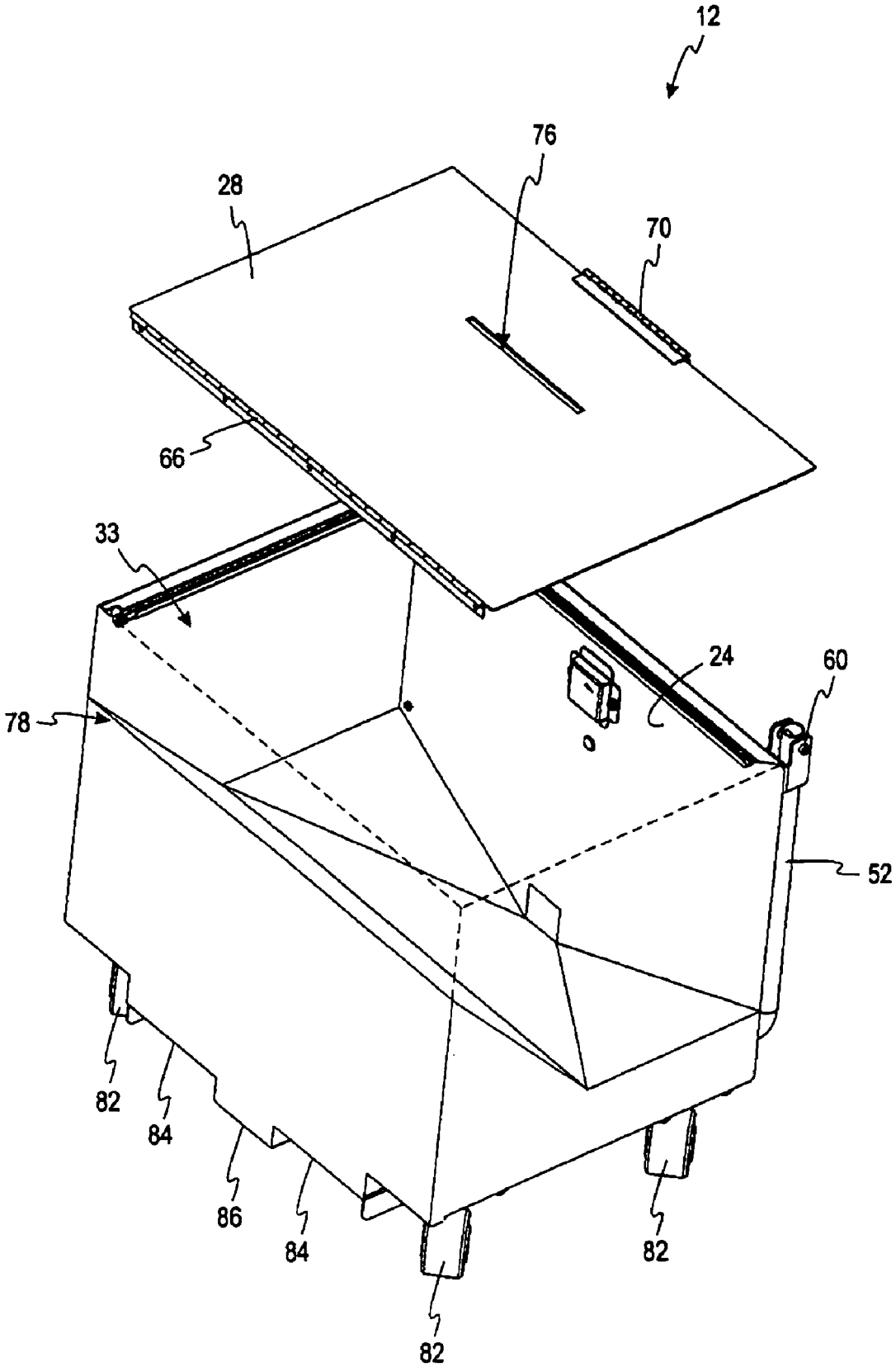
FIG. 8 is an exploded-perspective view of the coin bin of FIG. 1*a* with portions removed to shown the internal structure.

Referring also to FIGS. 4-6, one embodiment of a coin bin 12 for use with the coin processing device 14 will be described in detail. Generally, the coin bin 12 receives and hold coins processed by the coin processing device 14. In the illustrated embodiment, the bin 12 is generally rectangular-shaped having a front plate 24, a back plate 26, and a cover plate 28 that is connected to the back plate 26. A first side plate 30 and a second side plate 32 are rigidly connected to the front plate 24 and the back plate 26, forming the basic structure of the coin bin 12 and a coin depositing opening 33.

The front plate 24 includes a pocket 34 centrally located between the first side plate 30 and the second side plate 32, and a coin removal opening 36 located below the pocket 34. The pocket 34 is vertically oriented along the front plate 24, with its width being parallel to the cover 28, and it protrudes out of the front plate 24. The pocket 34 has a first open end 38 and a second open end 40, and it includes a pin hole 42 located proximate the first open end 38. The coin removal opening 36 is located next to the second open end 40 and it has a generally rectangular shape with a width smaller than the width of the pocket 34. An adjusting pin 44 is connected to the pocket 34 and can be inserted into the pin hole 42.

A gate 46 is a generally rectangular plate that includes at least one adjusting hole and a gate ridge 48, which has a first locking hole 50 located in a central position. The gate 46 slides through the pocket 34 between an up position and a down position. When in the up position, coins are allowed to move through coin removal opening 36. When the gate is in the down position, the gate 34 prohibits coins from moving through the coin removal opening 36. The gate 34 has a plurality of position setting for when in the up position to allow an attendant to adjust the removal rate of the coins. The pin 44 is used to fix the gate 46 in a particular up-position setting, as desired by the attendant, by protruding through one of the adjusting holes located in the gate 46. To release coins, the attendant pulls the pin 44, raises the gate 46 to the desired setting by lining up one of the adjusting holes, if there are more than one, with the pin hole 42, and then pushing the pin 44 into both the pin hole 42 and the adjusting hole to fix the gate 46 in the up position. Consequently, the coins inside the coin bin 12 are ready for removal. For a higher coin removal rate the pin 44 should be inserted into an adjusting hole that is located further away from the gate ridge 48, while for a lower coin removal rate the pin 44 should be inserted into an adjusting hole that is located closer to the gate ridge 48. To prevent the removal of coins, the attendant pulls the pin 44 and lowers the gate 46 until the coin removal opening 36 is completely covered by the gate 46.

The front plate 24 includes a handle 52 which is C-shaped and is made from a tube, such as a circular pipe. The handle 52 has in general three sections, a middle section 54 and two lateral sections 56, 58, each of the lateral sections being connected to the front plate 24 at a first pivoting point 60 and a second pivoting point 62. The handle 52 has two main positions, a collapsed position, as shown in FIGS. 4-6, and a transporting position (not shown). A purpose of the collapsed position is to make the coin bin 12 more compact, making sure that the handle 52 does not interfere with the coin processing or the coin removal. In the collapsed position, the handle 52 rests against the front plate 24, having the middle section 54 being positioned near the coin removal opening 36. A purpose of the transporting position is to allow the user the flexibility to move the handle 52 to a position that best fits the user's physical anatomy. For example, a taller person may lift the handle 52 higher than a shorter person. In the transporting position the handle 52 is pivoted upwards, by having an user raise the middle section 54 until the user reaches a comfortable position for using the handle 52 to push or pull the coin bin 12.

In other embodiments the front plate 24 also includes identification plates 64 that are located near the second pivoting point 62. The identification plates 64 can be used to identify relevant information regarding the coin bin 12 or the coin processing device 14, such as the coin bin model, the coin machine model, the owner of the coin bin 12, or the owner of the coin processing device 14, or other identification information.

The cover 28 is a lid that pivots on one end to the back plate 26 by using a first hinge 66 that covers nearly the entire width of the cover 28. The first hinge 66 allows the cover 28 to swing between an open position (FIG. 1) and a closed position (FIG. 5). In the closed position the cover 28 substantially covers the coin depositing opening 33, while in the open position the cover 28 at least partially uncovers the coin depositing opening 33. The coins are deposited or placed in the coin bin 12 through the coin depositing opening 33. The width of the cover 28 is the dimension of the cover 28 that is parallel to a line normal to the first and second sides plates 30, 32 that is normal to the plates 30, 32.

The cover 28 includes a locking plate 68 that is connected to the cover 28 with a second hinge 70. Because the locking plate 68 is hinged to the cover 28, it is free to pivot around the second hinge 70 having in general a locked position and an unlocked position. In general, the locking plate 68 is a rectangular plate having a ridge 72 at one end. The ridge 72 has a second locking hole 74 which is centrally located on the ridge 72, and which has the same general size and shape as the first locking hole 50. Similarly, the ridge 72 has the same general size and shape as the gate ridge 48. When the locking plate 68 is in the locked position, the ridge 72 fits generally over the gate ridge 48 having the second locking hole 74 line up with the first locking hole 50 on the gate 46. Consequently, the locking plate 68 and the gate 46 can be locked using a single locking device, such as a padlock. Therefore, the present invention contemplates a single-locking mechanism comprising the locking plate 68, the gate 46, and a single locking device that locks both openings to the coin bin 12.

Additionally, the cover 28 also includes a long slot 76 that is located in a generally central position for holding the locking plate 68 in a fixed position via a detent mechanism. When the cover 28 is in the open position, the long slot 76 can be used to prevent the locking plate 68 from interfering with the deposit of coins, by holding the locking plate 68 in a stationary position that does not interfere with the coin depositing opening 33. For example, the locking plate 68 can be swung upwards in a clockwise motion and laid flat on the cover 28 having the ridge 72 protruding through the long slot 76, wherein the ridge 72 can be temporarily secured in the long slot 76 using a detent mechanism or structure, e.g., a spring-loaded pin. The long slot 76 can also be used for the insertion of miscellaneous items after the coin bin 12 is locked by the user. Very often, for security reasons, the person transporting the coin bin 12 from one place to another cannot unlock it. However, additional items may have to be placed inside the coin bin 12, such as additional coins or verification receipts, after the coin bin 12 is locked. For example, when a person transporting the coin bin 12 delivers the bin 12, a verification receipt describing the status of the coin bin 12 (e.g., where the coin bin 12 was brought from, how much money is supposed to have, the name and signature of the transporting person, etc.) can be inserted through the long slot 76. Also, the long slot 76 can function as a visual check for an attendant to see how many coins are inside the coin bin 12, i.e., whether the coin bin 12 is full or empty.

Referring now to FIGS. 7-10, the coin bin 12 includes, in another embodiment, an interior sloped surface 78. The sloped surface 78 contains a plurality of planes which are arranged in angled positions that allows the coins to flow freely toward the coin removal opening 36 under the force of gravity. In one embodiment, the sloped surface 78 can be achieved by bending a single plate to achieve the desired plurality of planes. In another embodiment, the sloped surface 78 can be achieved by connecting a number of different plates, using commonly known means such as welding, soldering, or fasteners. The sloped surface 78, using the force of gravity, eliminates the necessity for manual intervention during the operation of removing coins. After the user opens the gate 46, the coins fall through the coin removal opening 36 until the coin bin 12 is completely empty or until the user closes the gate 46. In one embodiment the sloped surface 78 contains three planes (FIG. 8): two symmetrical side planes that are located on either side of the coin removal opening 36 and that have a triangular shape, and a larger central plane. One side of each of the side planes is connected to the interior of the front plate 24, while another side is connected to the respective one of the first side plate 30 and the second side plate 32. The remaining side of each of the side planes forms a common side with the central plane. The central plane has a parallelogram shape, which has a large parallel side, a small parallel side, and two equal connecting sides. Each of the connecting sides form a common boundary with one side of the side planes. The small parallel side forms the bottom edge of the coin removal opening 36, while the large parallel side is connected to the back plate 26.

Figure 9:
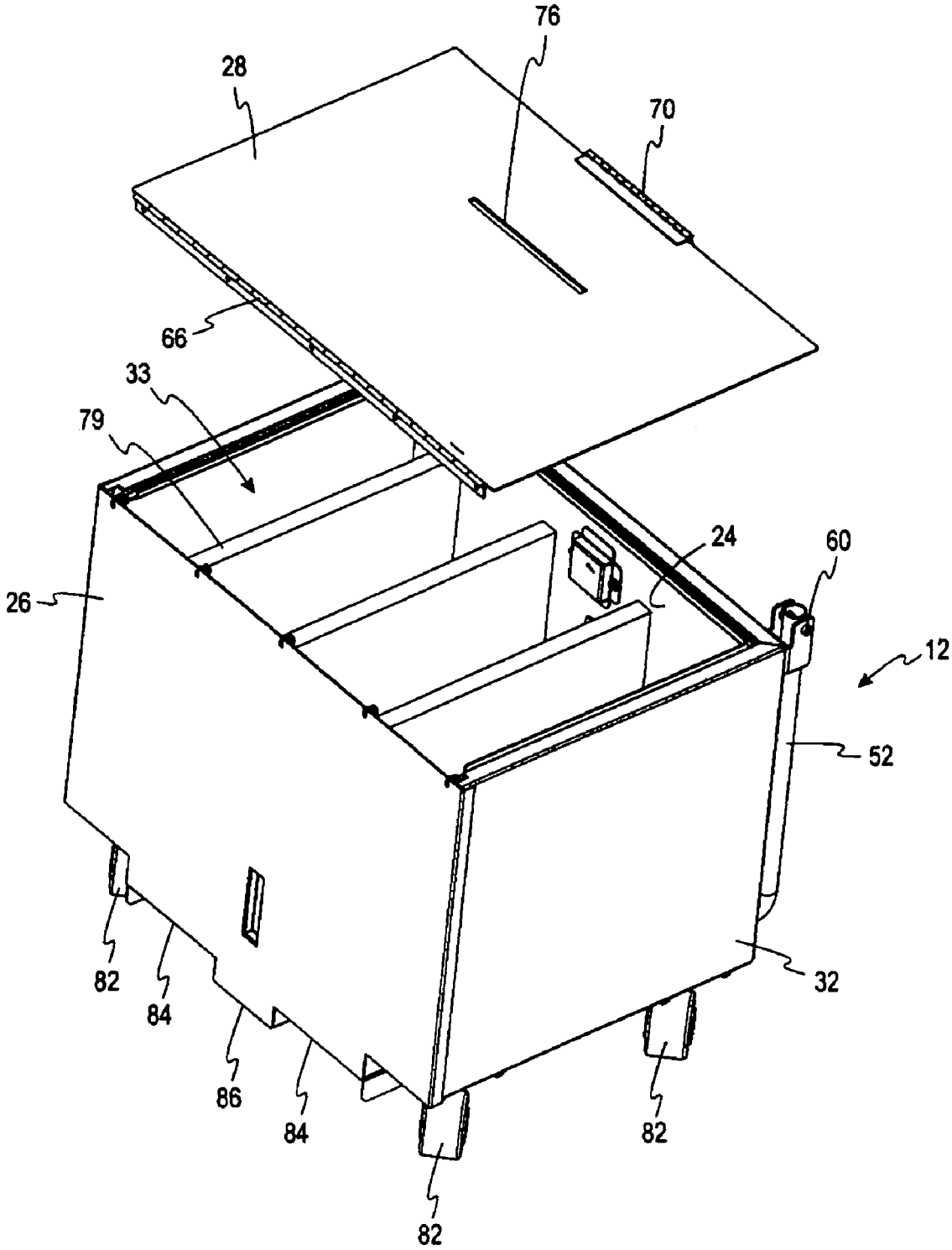
FIG. 9 is an exploded-perspective view of a coin bin according to an alternative embodiment.
Figure 10:
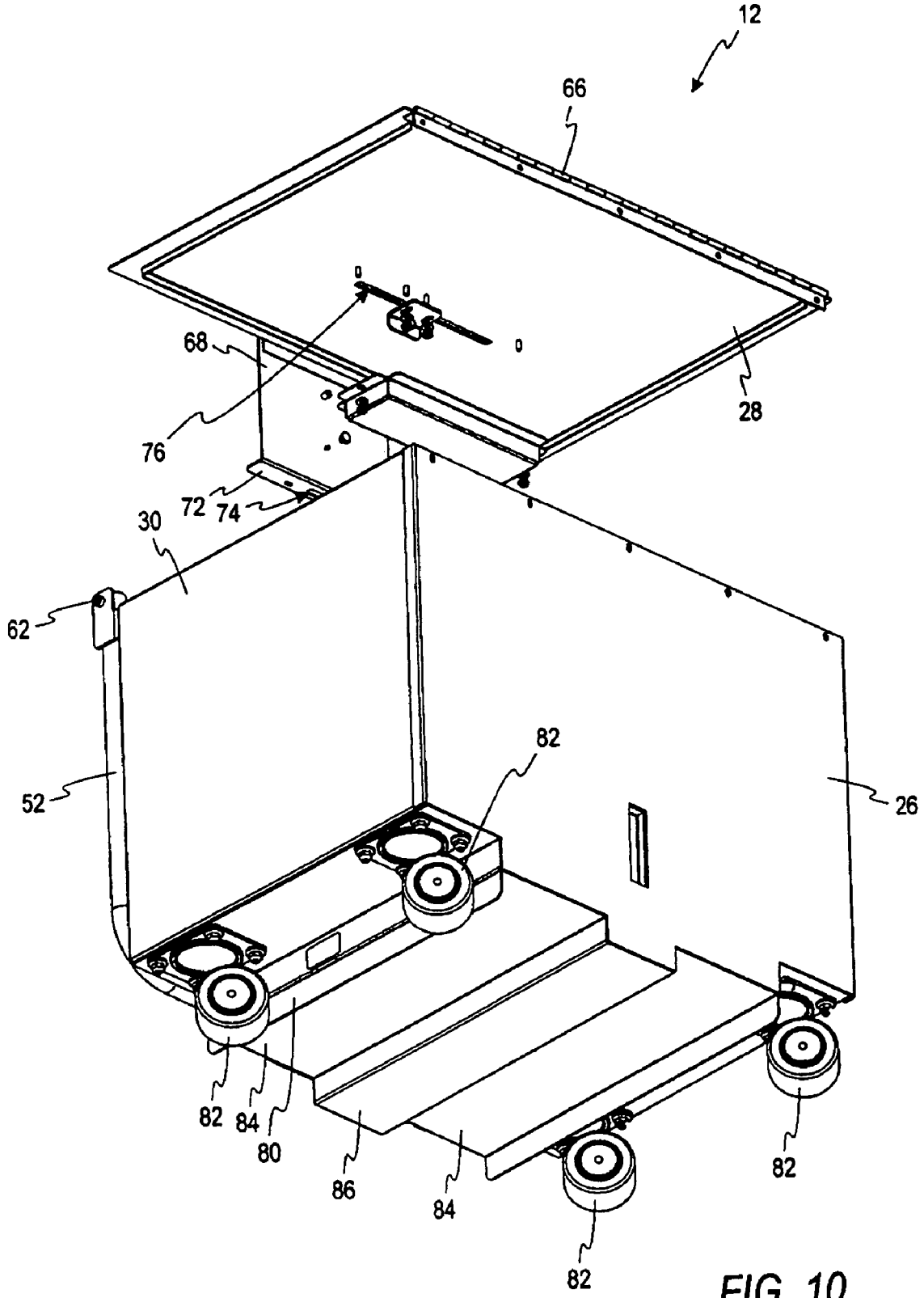
FIG. 10 is a perspective view coin bin of FIG. 1*a*.

In another embodiment the coin bin 12 includes a number of separating plates 79 for dividing the coin bin 12 into a plurality of compartments (FIG. 9). The compartments can be used to sort the coins by denomination, or to contain bags for holding a smaller number of coins. The bags contain in general less coins and are therefore lighter in weight than the coin bin 12, making them easier to transport. The compartments may comprise a plurality of compartment doors for controlling the flow of said coins in each compartment, wherein each one of the compartment doors is individually moveable.

The coin bin 12 also includes a bottom plate 80 which includes a plurality of wheels 82. Four wheels 82 are located in each corner of the bottom plate 80 to facilitate the easy movement of the coin bin 12 from one place to another. The wheels 82 are readily available commercial casters, selected to withstand the several hundred pound weight of the coins and coin bin 12. In other embodiments, the number of wheels varies from two wheels to as many as desired.

In another embodiment, the bottom plate 80 preferably has a number of grooves 84 which are separated by a central bar 86. Each one of the grooves 84 and the central bar 86 has two ends which form a longer dimension, the length, and are oriented such that one end of the length is near the front plate 24 while the other end is near the back plate 26. One of the functions of the grooves 84 is to allow the transportation of the coin bin 12 by using a forklift device, such as a hand or a motorized truck. In other embodiments two more side bars can be located parallel to the central bar 86 such that they restrict the forklift device from moving sideways, towards the wheels 82.

In other embodiments of the present invention, any one or more of the sloped surface 78, the front plate 24, the first side plate 30, the second side plate 32, the back plate 26, the cover 28, and the separating plates can be covered with a laminated material having multiple layers. The laminated material has two outer layers which are made of a metal, and a thin inner layer which is made of a non-metal that holds the outer two layers together. The thin inner layer serves to dampen the vibrations of coins impacting the outer layers. The inner layer converts the vibrational energy into thermal energy. The laminated material comes in a variety of thicknesses, with the smallest one being about 0.04 inch and the largest being about 0.375 inch. Preferably, the laminated material is a stainless steel. Such materials are available through various sources, including Classic Sheet Metal in Schiller Park, Ill. A laminated material similar to the one that was described above is described in greater detail in U.S. Patent Application Publication No. US 2002/0130011 A1, entitled "Coin Processing Machine Having Coin-Impact Surfaces Made From Laminated Metal," which was filed on Mar. 19, 2001 and is incorporated herein by reference in its entirety.

Figure 11:
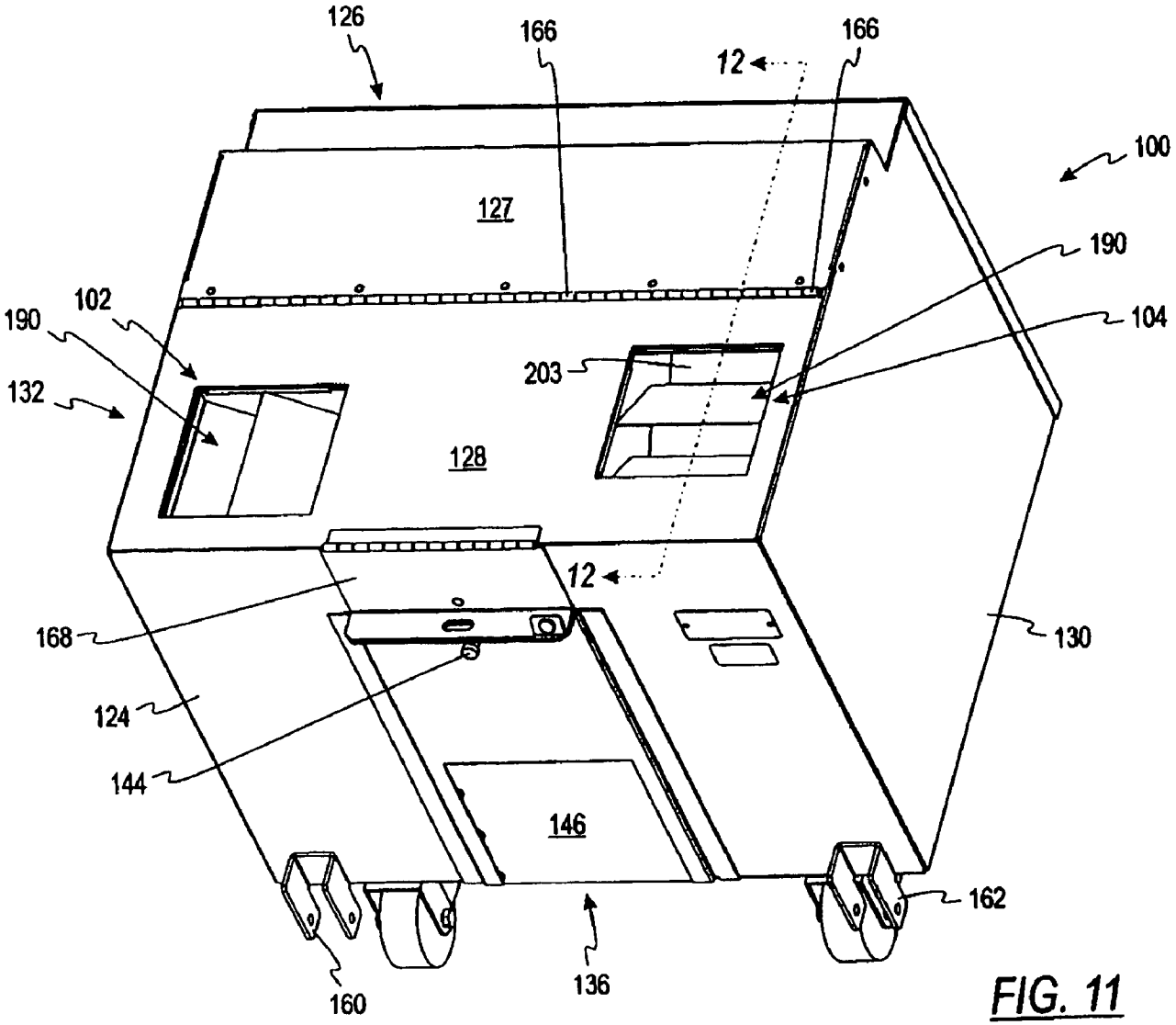
FIG. 11 is a perspective view of a coin bin in accord with the present concepts.

Referring now to FIG. 11, a coin bin 100 is shown according to an alternative embodiment of the present invention. The coin bin 100 includes a first coin input area 102 and a second coin input area 104 for receiving coins processed by the coin processing device 14 (FIG. 1). Generally, as will be described in greater detail, the first and second coin input areas 102, 104 each include a security grate that comprises a plurality of slats that are angled in a manner to limit access to the interior of the coin bin 100. The slats of the security grates are sized and spaced to allow the flow of coins from the coin processing device 14 into the coin bin 100, but to at least inhibit most human hands and arms from accessing coins contained within the coin bin 100. In operation, processed coins output by the coin processing device 14 are directed (e.g., via funnels) to one of the coin input areas 102, 104 where the processed coins flow through the security grates into the coin bin 100.

The coin bin 100 is similar in several respects to the coin bin illustrated in FIGS. 4-8. The coin bin 100 includes four sides 124, 126, 130, and 132. The front side 126 includes a gate 146 that vertically moves from a closed position (FIG. 11) to an open position (not shown) for exposing the coin removal opening 136. The coin bin 100 includes a pin 144 for maintaining the gate 146 in one or more open positions as described above. The coin bin 100 includes one or more sloped interior bottom surfaces 178*a,b,c* (FIG. 12) that directs coins toward the coin removal opening 136. The coin bin includes first and second pivoting brackets 160 and 162 to which a handle 54 (FIG. 4) is pivotally mounted.

The coin bin 100 includes a cover having a stationary portion 127 that does not move and a pivotal lid 128 that is a pivotally attached to the coin bin 100 by a hinge 166. The pivotal lid 128 upwardly pivots to allow access to the coins contained within the coin bin 100. A locking plate 168 is hingedly attached to the front end of the pivotal lid 128. The locking plate 168 is used for locking the pivotal lid 128 and the gate 146 to prevent opening the pivotal lid 128 or the gate 146 as is described above in connection with FIGS. 4-6. The pivotal lid includes two apertures 190 corresponding to the two coin input areas 202, 204 of the coin bin 100.

Figure 12:
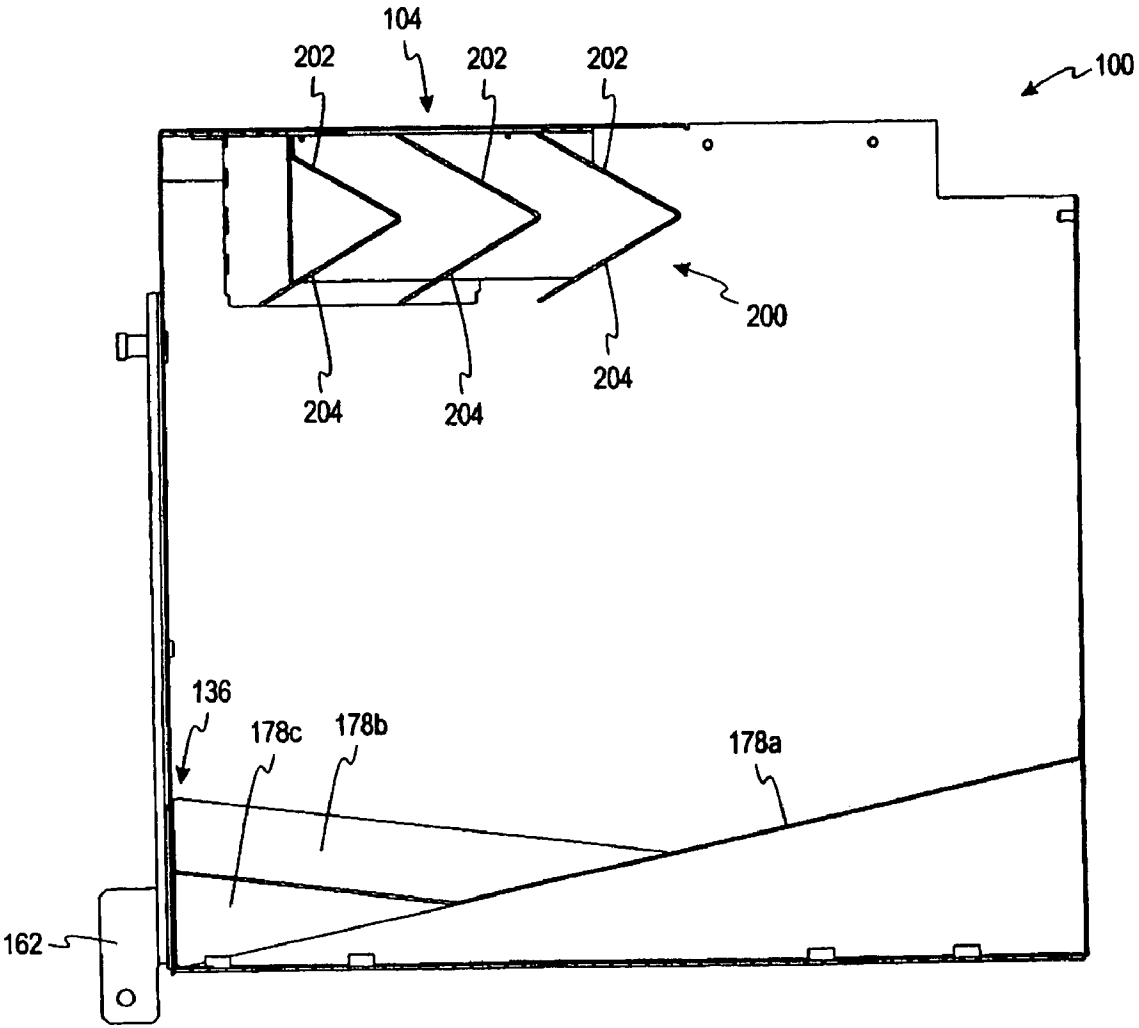
FIG. 12 is a sectional view taken along line 12-12 of FIG. 11.

Referring also to FIG. 12, disposed below each aperture 190 of each coin input area 202, 204 is a security grate 200 that comprises a plurality of upper slats 202 and lower slats 204. The upper slats 202 are generally parallel to the other upper slats 202, and the lower slats 202 are generally parallel to the other lower slats 202. The slats are generally rectangular in shape and disposed such that a wide edge of the slat is generally parallel with the horizontal. Each upper and lower slat 202, 204 is arranged in a generally V-shaped configuration as shown in FIG. 12. The upper and lower slats 202, 204 may be integrally formed such that they are formed from the same piece of material as illustrated, or my comprise separate pieces.

Figure 13:
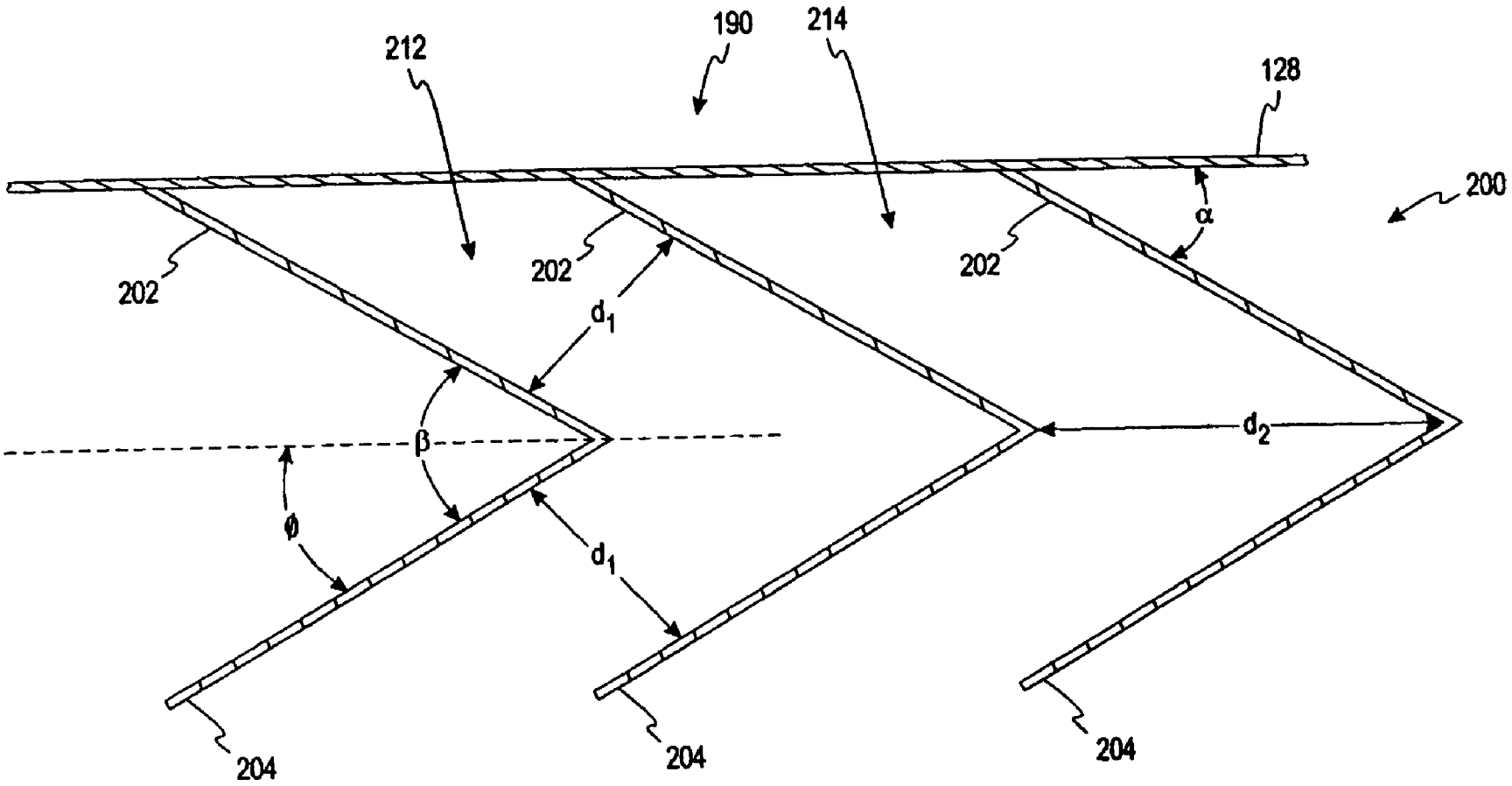
FIG. 13 is a side view of a security grate in accord with the present concepts.

Referring also to FIG. 13, the upper and lower slats 202, 204 of a security grate 200 are shown. During the processing of coins by the coin processing device 10 (FIG. 1), processed coins are output to the coin input areas 102, 104. The three pairs of upper and lower slats 202, 204 form a first coin path 212 and a second coin path 214 between the slats 202, 204 through which processed coins move under the force of gravity. As the coins move through the coins paths 212, 214 of the security grate 200, the coins contact the various surfaces of the slats 202, 204. The upper slats 202 direct the coins in a first direction (down and to the right as viewed in FIGS. 12 and 13) and the lower slats 204 direct the coins in a second direction (down and to the left as viewed in FIGS. 12 and 13) as the coins move along the coin paths 212, 214. While the illustrated security grate 200 includes two coins paths 212, 214, the security grate may have any practical number of coins paths in alternative embodiments of the present invention. Because the slats 202, 204 are subjected to forces applied by the moving coins, the slats 202, 204 are constructed of rigid, durable material such as steel, another rigid metal or alloy, or other rigid material. Additionally, as described later, the ends of the slats 202, 204 may be supported to increase the rigidity of the security grate 200.

The bidirectional coin paths 212, 214 of the security grate 200 effectively prohibit or inhibit a person from accessing the coins within the coin bin 100 through the coin input areas 102, 104 of the storage bin. Put another way, the nonlinear nature of the coin paths 212, 214 prohibit an unscrupulous person from reaching into the coin bin 100. When the gate 144 is locked to the locking plate 168 via a padlock, for example, as is described above, the coin bin 100 provides a secure receptacle for holding coins. Thus, only those authorized to access the coins in the coin bin 100 may access the coins when the gate 144 and locking plate 168 are locked.

The dimensions of the security grate 200 are described according to one embodiment of the present invention. The upper slats 202 are disposed a distance $d_1$ from an adjacent upper slat 202 in a direction normal to an upper slat 202. The lower slats 204 are also disposed an approximately equivalent distance $d_1$ from an adjacent lower slat 204. The distance $d_1$ is slightly larger than the diameter of the largest coin to be processed. When, for example, the coin processing device 10 is placed in a grocery store in the U.S., the largest-diameter coin typically encountered is a U.S. half-dollar, which has a diameter of about 1.205 inch. And, in this application, the distance $d_1$ would be about 1.31 inch. In the horizontal direction, the pairs of slats 202, 204 are disposed a distance $d_2$ from the adjacent pair of slats 202, 204. The distance $d_2$ is about 2.62 inches according to one embodiment of the present invention. Each of the upper slats 202 are disposed at an angle $\alpha$ relative to the pivotal lid 128 of about 30°. Each of the lower slats 204 are disposed at an angle $\beta$, which is about 60°, relative to the respective upper slats. The lower slats 204 are downwardly angled from the horizontal at an angle $\phi$ of about 30°. The upper and lower slats 202, 204 are similarly dimension according to one embodiment of the present invention and have a width of about 5 inches and a length of about 3 inches.

These dimensions may be varied in other alternative embodiments of the present invention. For example: $d_1$ may range between about 1.25 inch and about 1.30 inch; $d_2$ may range between about 2.50 inch and about 2.76 inch; angle $\alpha$ may range between about 22° and about 90°; angle $\beta$ may range between about 44° and about 180°; angle $\phi$ may range between about 22° and about 90° inch; the width of the upper and lower slats vary may range between about 1.25 inches and about infinite inches; and the length of the upper and lower slats vary may range between about 2.50 inches and about 10 inches according to various alternative embodiments of the present invention. Alternatively, the upper slats 202 may be sized differently than the lower slats 204 of the security grate 200.

Figure 14:
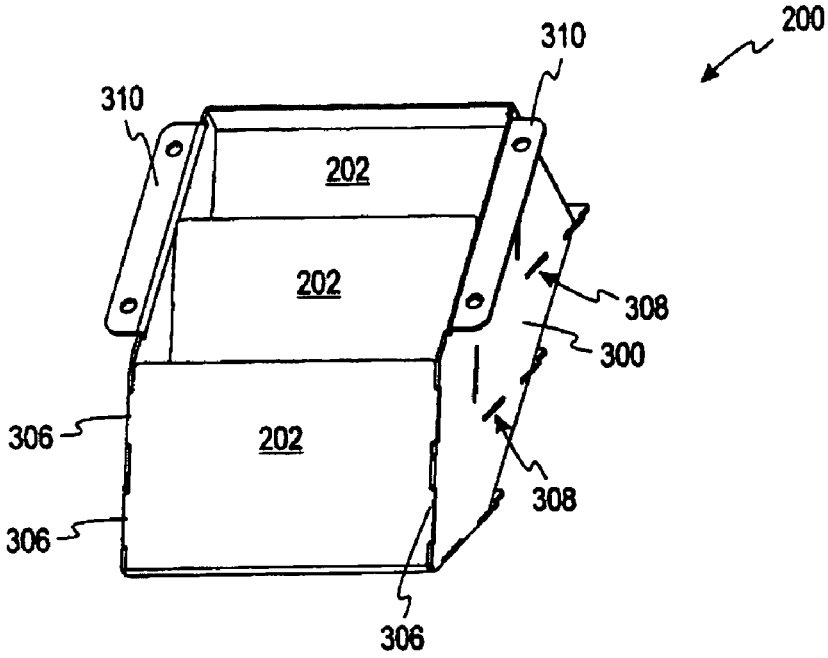
FIG. 14 is a perspective view of a security grate in accord with the present concepts.
Figure 15:
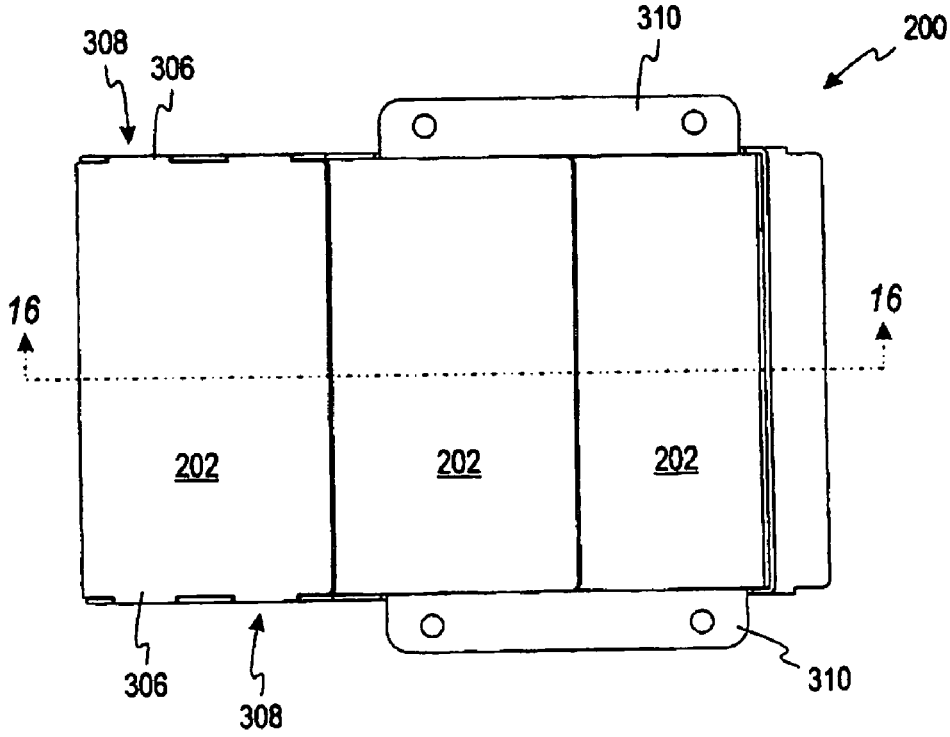
FIG. 15 is a top view of the security grate of FIG. 14.
Figure 16:
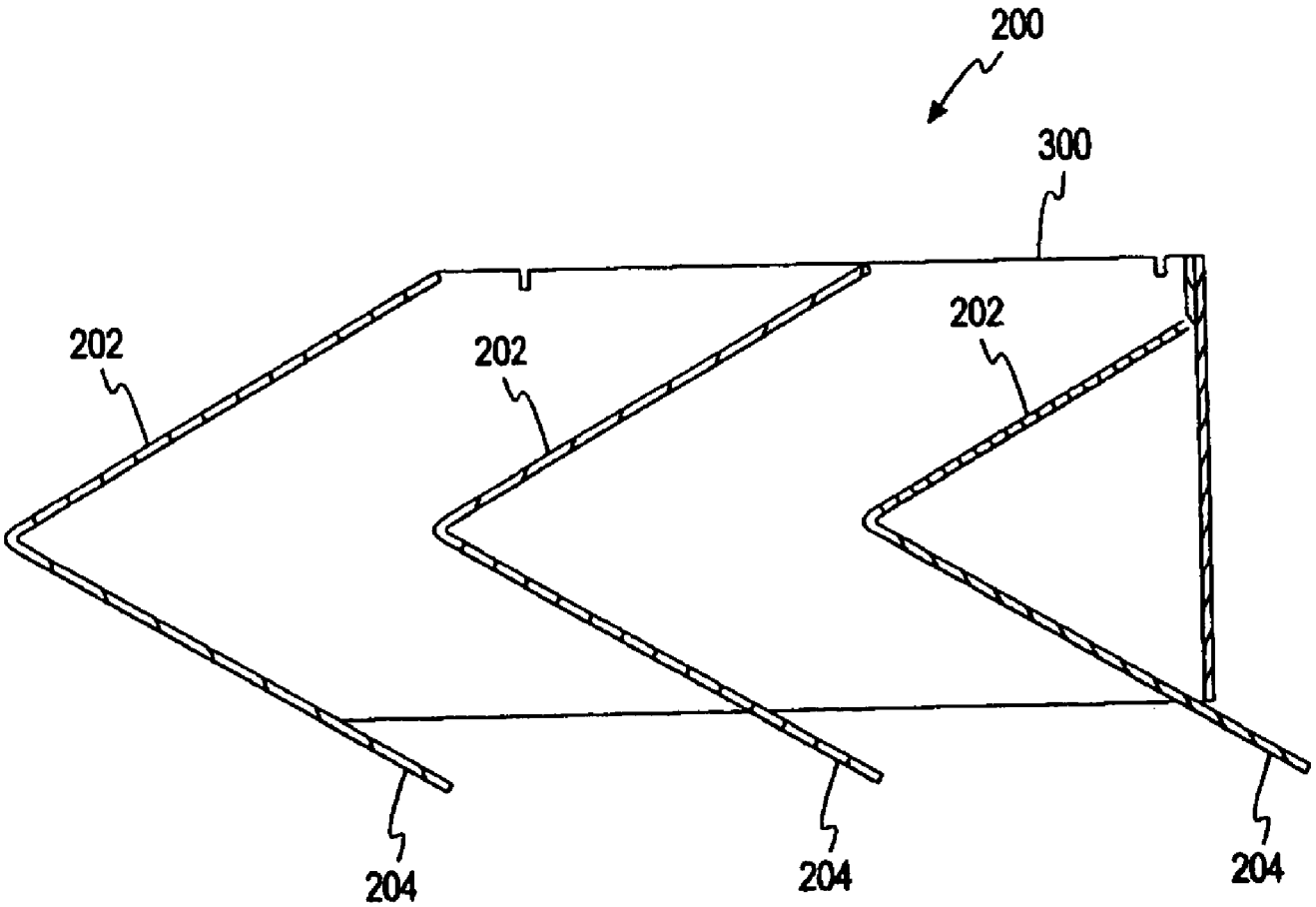
FIG. 16 is a sectional view taken along line 16-16 in FIG. 15.

Referring now to FIGS. 14-16, a bracket 300 for holding the upper and lower slats 202, 204 of the security grate 200 is shown. In the illustrated embodiment, each of pair of upper and lower slats 202, 204 are formed from the same piece of material that is angled in the V-shaped confirmation. Each of the slats 202, 204 include a plurality of outwardly-extending tabs 306 that mate with corresponding apertures 308 in the bracket 300. The tabs 306 and corresponding apertures 308 hold the slats 202, 204 in place at multiple points to maintain the position of the slats 202, 204 as the slats 202, 204 are contacting by the moving coins. The bracket 300 includes a pair of flanges 310 for mounting the bracket—and, thus, the security gate—to the underside of the coin bin's pivotal lid 129. The bracket 300 holds the slats 202, 204 in place and also supports the edges of the slats 202, 204 as coins move across the slats 202, 204.

As is apparent from the foregoing, the security grate 200 provides a physical barrier, or at least a physical deterrent from, for preventing an unauthorized individual from accessing coins contained within the coin bin 100. Further, the security grate 300 also provides a visual barrier, or a visual deterrent, for preventing an unauthorized individual from visually accessing the coins contained within the coin bin. Put another way, due to the slats 202, 204 angling in one direction and then the other, a person cannot view the coins contained within the coin bin. Thus, the security grates 200 provide a psychological barrier to prevent an unauthorized individual person from accessing the coins contained within the coin bin.

Thus far, the security grate has been discussed as a security feature to prevent unauthorized individuals from accessing coins contained within the coin bin. However, in other alternative embodiments of the present invention, other security features may be implemented. For example, a security screen may cover the apertures 190 (FIG. 11) of the coin input areas 102, 104. While a screen may not provide a visual barrier as discussed above, a screen would provide a physical barrier to prevent an unauthorized individual person from accessing the coins contained within the coin bin. In such an embodiment, the screen has openings sized large enough to allow coins to flow through the screens (e.g., openings dimensioned slightly larger than the diameter of the largest coin to be processed), but small enough to prevent a human hand from reaching through a screen opening to access the coins contained within the coin bin. The screen is constructed out of a strong material such as metal, for example, and sized such that is difficult to cut or otherwise damage the screen in an unauthorized attempt to access the coins contained within the coin bin.

Many other types of security features may also be implemented in alternative embodiments of the present invention.

While the invention is susceptible to various modifications and alternative forms, specific embodiments are shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A security grate for limiting access to a coin bin, comprising:

a first coin path defined by at least a first upper slat and a first lower slat, the first upper slat being disposed in a generally downwardly first direction and the first lower slat being disposed in a generally downwardly second direction;

a second coin path defined by at least a second upper slat and a second lower slat, the second upper slat being disposed in said generally downwardly first direction and the second lower slat being disposed in said generally downwardly second direction;

a third coin path defined by at least a third upper slat and a third lower slat, the third upper slat being disposed in a generally downwardly third direction and the third lower slat being disposed in a generally downwardly fourth direction, wherein the first upper slat, second upper slat, and third upper slat are disposed to receive coins from a coin source and to facilitate movement of such coins downwardly to the respective first lower slat, second lower slat, and third lower slat, wherein the gaps between adjacent slats are dimensioned slightly larger than the diameter of the largest coin to be passed therethrough; and wherein the first direction, second direction, third direction, and fourth direction are different from one another.

2. A security grate for limiting access to a coin bin according to claim 1, wherein said first upper slat and said first lower slat are disposed adjacent to and substantially parallel to a corresponding one of the second upper slat and the second lower slat to form a substantially constant gap therebetween.

3. A security grate for limiting access to a coin bin according to claim 2, wherein said third upper slat and said third lower slat are disposed substantially perpendicularly to said first upper slat, said first lower slat, said second upper slat, and said second lower slat.

4. A security grate for limiting access to a coin bin according to claim 1, wherein said third upper slat and said third lower slat are disposed substantially perpendicularly to said first upper slat, said first lower slat, said second upper slat, and said second lower slat.

5. A security grate for limiting access to a coin bin according to claim 2, wherein said fourth direction is substantially perpendicular to said first direction and said second direction.

6. A security grate for limiting access to a coin bin according to claim 2, wherein said fourth direction is at an angle to said first direction and said second direction.

7. A security grate for limiting access to a coin bin, comprising:

a coin path defined by at least an upper slat and a lower slat, the upper slat being disposed in a generally downwardly first direction and the lower slat being disposed in a generally downwardly second direction;

another coin path defined by another upper slat and another lower slat, said another upper slat being disposed in a generally downwardly third direction and said another lower slat being disposed in a generally downwardly fourth direction, wherein the upper slat and said another upper slat are disposed to receive coins from a coin source and to facilitate movement of such coins downwardly to a respective one of said lower slat and said another lower slat, wherein the gaps between each of said upper slat and lower slat and said another slat and said another lower slat are dimensioned slightly larger than the diameter of the largest coin to be passed therethrough; and wherein the first direction, second direction, third direction, and fourth direction are different from one another.

8. A security grate for limiting access to a coin bin, comprising:

a coin path defined by at least an upper slat and a lower slat, the upper slat being disposed in a generally downwardly first direction and the lower slat being disposed in a generally downwardly second direction;

another coin path defined by another upper slat and another lower slat, said another upper slat being disposed in a generally downwardly third direction and said another lower slat being disposed in a generally downwardly fourth direction, wherein the upper slat and said another upper slat are disposed to receive coins from a coin source and to facilitate movement of such coins downwardly to a respective one of said lower slat and said another lower slat, wherein the gaps between at least one of said upper slat and lower slat and said another upper slat and said another lower slat are dimensioned slightly larger than the diameter of the largest coin to be passed therethrough; and wherein the first direction, second direction, third direction, and fourth direction are different from one another.

9. A security grate for limiting access to a coin bin, comprising:

a coin path defined by at least an upper slat and a lower slat, the upper slat being disposed in a generally downwardly first direction and the lower slat being disposed in a generally downwardly second direction;

another coin path defined by another upper slat and another lower slat, said another slat being disposed in a generally downwardly third direction and said another lower slat being disposed in a generally downwardly fourth direction, wherein the upper slat and said another upper slat are disposed to receive coins from a coin source and to facilitate movement of such coins downwardly to a respective one of said lower slat and said another lower slat, wherein the gaps between at least one of said upper slat and lower slat and said another upper slat and said another lower slat are dimensioned to prevent access to an interior of a coin bin therethrough by a human hand; and wherein the first direction, second direction, third direction, and fourth direction are different from one another.

* * * * *

UNITED STATES PATENT AND TRADEMARK OFFICE

CERTIFICATE OF CORRECTION

PATENT NO. : 7,658,270 B2
APPLICATION NO. : 10/966857
DATED : February 9, 2010
INVENTOR(S) : Bochonok et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 961 days.

Signed and Sealed this

Thirtieth Day of November, 2010

David J. Kappos

David J. Kappos
*Director of the United States Patent and Trademark Office*